US006014843A

United States Patent [19]

Crumley et al.

[11] Patent Number: 6,014,843

[45] Date of Patent: Jan. 18, 2000

[54] WOOD FRAME BUILDING STRUCTURE WITH TIE-DOWN CONNECTORS

[76] Inventors: Harvel K. Crumley, 1097 Lynmoor Dr., NE., Atlanta, Ga. 30319; Charles T. Brackett, 13440 Gerona Dr. North, Jacksonville, Fla. 32246

[21] Appl. No.: 09/023,445

[22] Filed: Feb. 13, 1998

[51] Int. Cl.[7] ..... E04H 9/02

[52] U.S. Cl. ..... 52/167.3; 52/4; 52/223.1; 52/223.8; 52/481.1; 52/695; 52/712; 403/300; 403/308; 403/331; 403/353

[58] Field of Search ..... 52/23, 167.3, 712, 52/695, 481.1, 801.1, 223.8, 223.1, 4; 403/300, 308, 353, 331

[56] References Cited

U.S. PATENT DOCUMENTS

| | | | |
|---|---|---|---|
| 1,363,407 | 12/1920 | Goudie | 52/695 |
| 2,126,511 | 8/1938 | Soule | 189/34 |
| 2,837,776 | 6/1958 | Klein | 20/113 |
| 5,386,671 | 2/1995 | Hu et al. | 52/167.3 |
| 5,600,923 | 2/1997 | Riley | 52/79.9 |
| 5,660,006 | 8/1997 | Emerson, Jr. | 52/127.2 |
| 5,687,512 | 11/1997 | Spoozak et al. | 52/23 |

*Primary Examiner*—Christopher T. Kent
*Assistant Examiner*—Nkeisha J. Maddox
*Attorney, Agent, or Firm*—Arthur G. Yeager

[57] ABSTRACT

Wood framed walls of buildings are strengthened against destructive wind and seismic forces by spaced lengths of vertical wire rope having enlarged bulbous portions swagged on each end. A metal sleeve and a metal plate are slipped onto such lengths prior to swagging. Other lengths of wire rope only having bulbous portions are connected to attachments after forming a cross brace, and at least one cross brace is located in each major wall of a one-story building. The cross brace can be attached to a foundation structure of the building below a floor plate and/or to a stud and floor plate. The foundation structure may be concrete or other floor joist or the like. The wire ropes, may be located on a first story with another cross brace on another story thereabove with metal rods therebetween or the wire ropes forming two generally vertical cross braces may be formed from a pair of wire ropes with two metal sleeves between the stories through which the wire ropes extend. Several special connectors and embodiments are included.

28 Claims, 7 Drawing Sheets

WOOD FRAME BUILDING STRUCTURE WITH TIE-DOWN CONNECTORS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates generally to wood frame building structures, and more particularly to structures exposed to extreme wind and/or seismic conditions where building codes dictate that these structures be protected against structural failure and/or to save lives of occupants.

Wood structures predominate in residential and light commercial construction, and when wood framing is employed the structure must be protected from upward, shear and overturning loads developed by either wind or seismic activity which differs with geographical location and is enforced by different building codes for these areas. In the case of upward loads, the building is generally tied to the foundation using a variety of steel connectors that tie the bottom plate to the foundation, studs-to-plates, floors-to-walls (in the case of two or more floors), and roof-to-walls. Typically, for uplift, connectors are attached to every stud (16" O.C.), or at least every other stud (32" O.C.). Shear and overturning loads are resisted by a combination of heavy duty steel connectors, (either bolted to, or embedded in, the foundation, and nailed or bolted to the wood frame), and an approved structural sheathing material nailed directly to the exterior of the structure is used to create what is referred to as a "shear wall". The size and number of these steel connectors vary depending on the severity of the wind and/or seismic conditions in the locality of the building, and the building's geometry.

In the United States these connectors are installed during the foundation and framing stages of construction. Connectors and sheathing are generally installed by laborers hired by the framing contractor. Correct size, location and number of fasteners, (nails or bolts), are critical to the required load. Commonly, these laborers are inexperienced which results in improper or inadequate installation. In all structures, locations of connectors mandate their installation during the framing stage due to related components being placed at the same time. This process slows the foundation and framing stages of construction which in turn increases labor costs. Also, existing structures without having these connectors in place are at risk of destruction should a hurricane or earthquake occur.

From the foregoing, it is apparent that there is a critical need for a structural tie-down system that provides for uplift, shear and overturning loads that is cost effective, installed after the foundation and framing stages of the building is complete, and is independent from structural wall sheathing as a integral part of the system.

BRIEF SUMMARY OF THE INVENTION

This invention relates to a novel wood framed building, e.g., a residential dwelling, having a structure including a foundation upon which rests a plurality of parallel vertical studs separating horizontal floor plates from horizontal ceiling plates, the structure being reinforced against the destructive forces of the atmosphere and of seismic origin by lengths of wire rope forming criss-cross connections between floor plates and ceiling plates and vertical connections between those plates and the concrete foundation. The wire rope is connected to the structure by way of bulbous terminals or threaded rod on the wire rope that are fastened to fixtures attached to beams in the house structure and to anchors buried in the foundation or attached to joists of the flooring structure.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
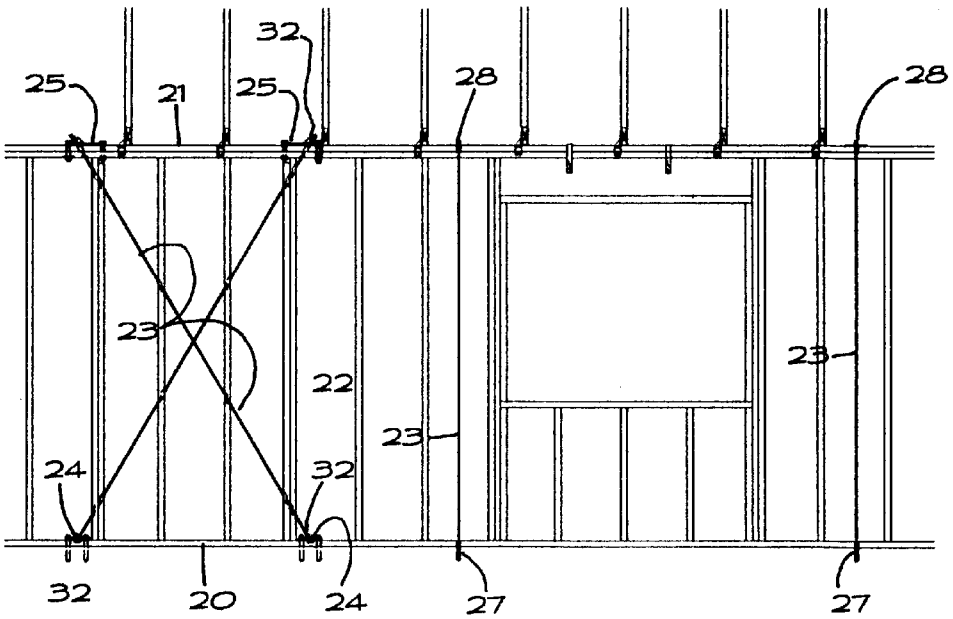
FIG. 1 is a front elevation of a one-story wood frame building structure showing a typical attachment of fixtures and tie-down wire ropes used to reinforce the structure against some of the heavy winds and some of the earthquake destructive forces according to this invention.
Figure 2:
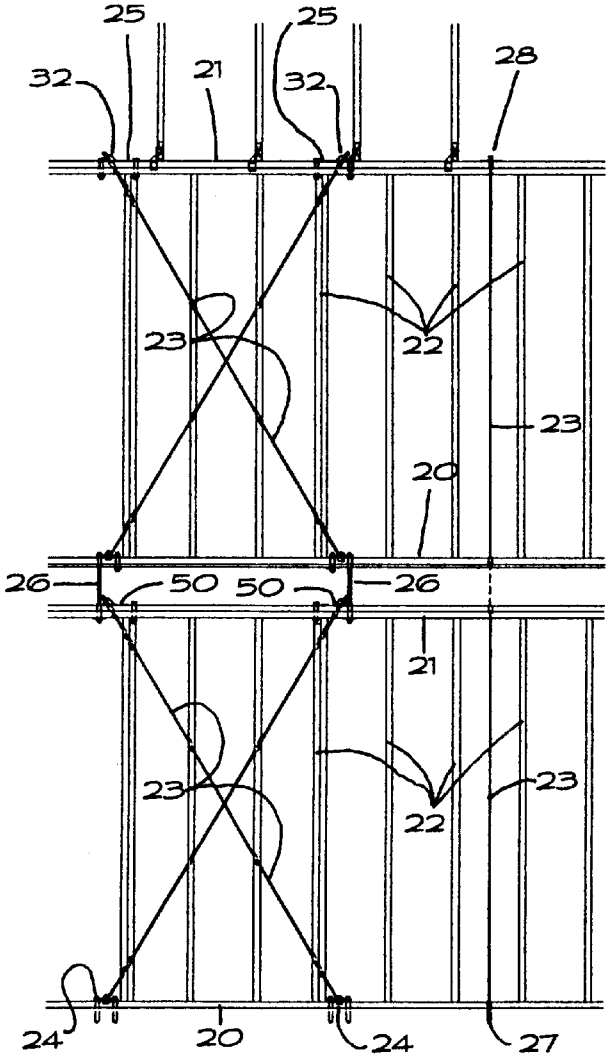
FIG. 2 is a front elevation of a two-story structure, similar to FIG. 1 showing a typical attachment of fixtures and tie-down wire ropes used to reinforce the structure according to this invention.

This invention may be best understood by reference to the attached drawings wherein FIGS. 1 and 2 show the general usage of the invention, and FIGS. 3–10 show the details of the invention.

In FIG. 1 there is shown the inside of a first-floor room of a wooden structure in which the framing consists principally of floor plates 20 and ceiling plates 21 joined together by a plurality of vertical parallel studs 22. The wall is reinforced according to this invention by one or more pairs of criss-crossed lengths 23 of wire rope, especially aircraft wire rope which may be coated with a plastic covering. The wire rope sections 23 are fastened to the wooden floor plates 20 and to the wooden ceiling plates 21. The principal fixtures to tie down the wire rope in these criss-cross sections are those shown in FIGS. 4 and 5, the former being affixed to the floor plates and the latter to the ceiling plates. As may be seen in FIGS. 4 and 5, the floor plate fixture comprises a short section of a right angle bracket 29 having a slot 30 in it to secure an enlarged button terminal 31 on the wire rope strands. A base plate 32 serves as a secure connection for bracket 29 which lies on floor plates 20. A small cut out section 49 may be needed to provide room to accommodate the edges of button 31 and wire rope 23 extending below the level of base plate 32. An additional connection for plate 32 includes two threaded studs 33 (with nuts 34) buried in a concrete foundation 35. Preferably the concrete foundation 35 is poured and the floor plates 20 and foundation 35 are subsequently drilled to receive studs 33 which are received in the drilled holes in the concrete foundation 35 after the holes are partially filled with adhesive, for example, epoxy, polymers, expanding cements, etc. It is understood that foundation other than slab foundations are within the purview of this invention such as a basement or stem wall which may have a wood floor system between the bottom plate and the embedment into concrete. Nuts 34 may be tightened on studs 33 to make wire rope 23 taut, i.e., there is a space between metal plate 32 and wood floor plate 20.

Figure 5:
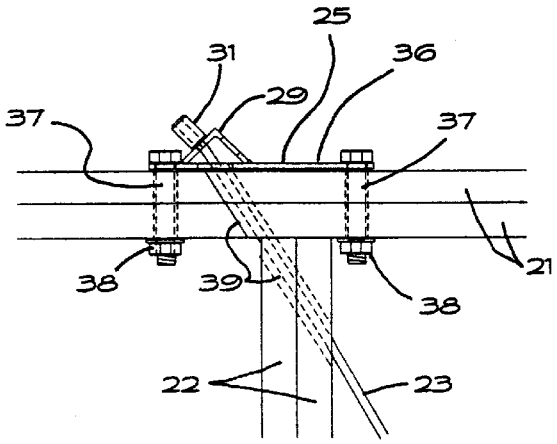
FIG. 5 is an elevational view of an attachment of a wire rope reinforcement to a ceiling plate in accordance with the present invention.
Figure 4:
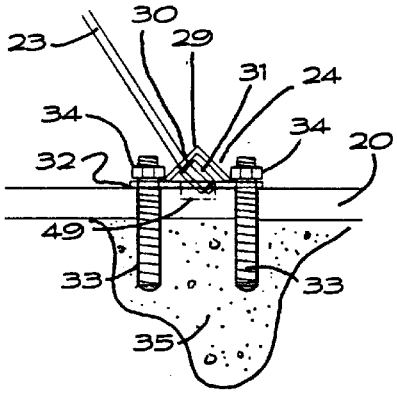
FIG. 4 is a cross-sectional view of another embodiment of the attachment for wire rope in accordance with the present invention.

The upper terminals for the crisscrossed wire rope sections 23, as shown in FIG. 1 are those of FIG. 5. This upper fixture has many features similar to those described with respect to FIG. 4. Wire section 23 is fitted with a button terminal 31 on its upper end exactly like the one employed on its lower end, as shown in FIG. 4. A right angle bracket 29 (like that shown in FIG. 4) is used to fasten the wire rope 23 at button 31 of FIG. 5. The remainder of the fixture consists of a metal base plate 36 which is fastened to the two ceiling plates 21 by two bolts 37 and preferably two nuts 38 or two wood screws or nails may be used as desired. No connection is required since the passage of the wire rope through the passageway in ceiling plate 21 is sufficient to fix the position of the ceiling plate 40 above wooden ceiling plates 21. As may be seen, wire rope 23 extends through a drilled hole extending angularly toward the terminal in the floor plate 20 as illustrated in FIG. 4. Bracket 29 may differ slightly in FIG. 5 from the one shown in FIG. 4, but only by reason of its orientation in serving as a terminal for wire rope 23 extending upwardly (in FIG. 4) or downwardly (in FIG. 5).

Figure 3:
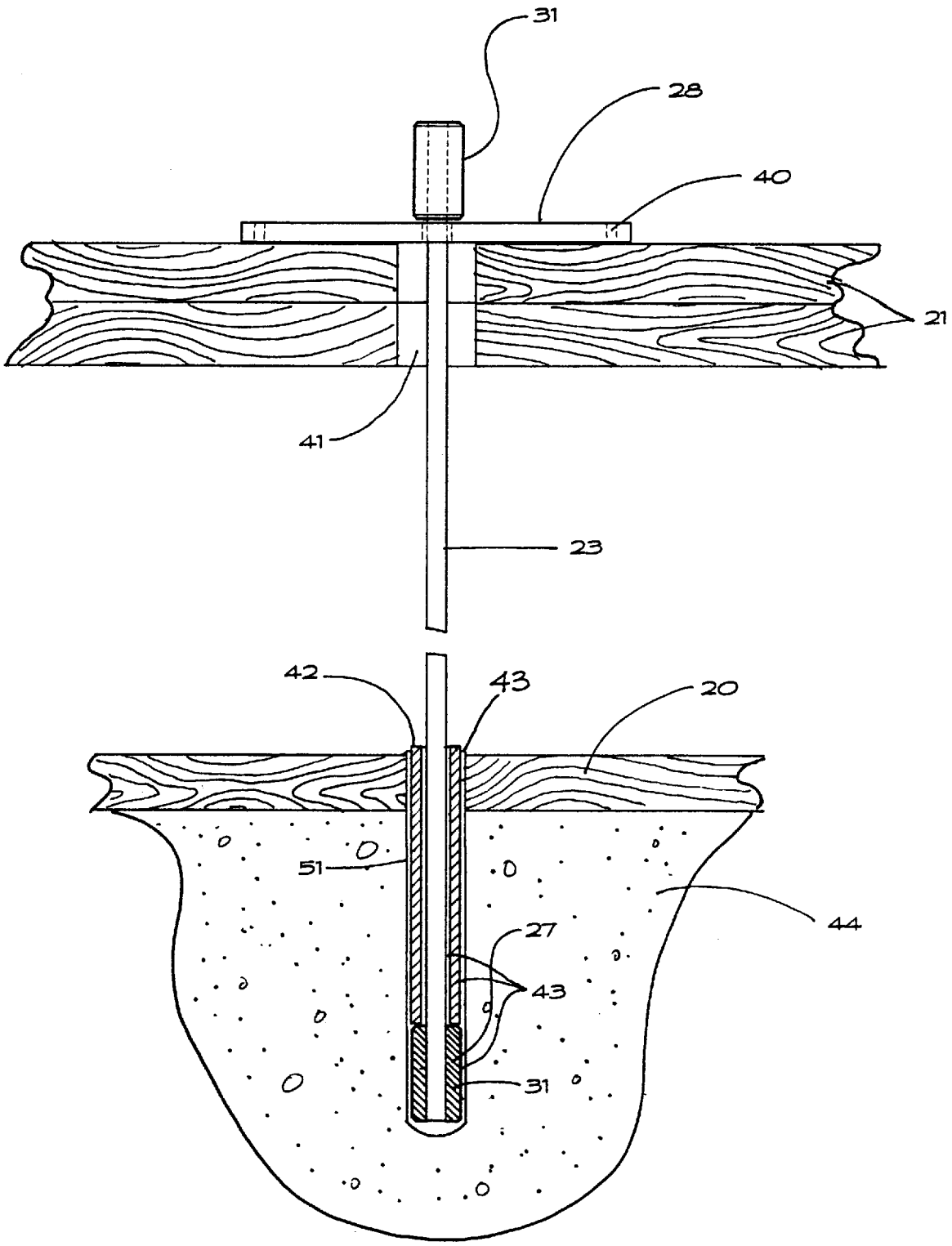
FIG. 3 is a cross-sectional view of the wire rope attachment to the ceiling plate and to a buried anchor in a slab foundation in accordance with the present invention.

There also is shown in FIGS. 1 and 2 the simple reinforcement of a linear section of wire rope used to tie a roof structure or an upper floor structure to the base of the structure or to a lower floor of a structure. This type of reinforcement is shown in FIGS. 1 and 2 wherein fixtures 27 and 28 are attached to a vertical length of wire rope 23. The fixtures 27 and 28 are illustrated in FIGS. 1–3 wherein the upper end of wire rope section 23 is fitted with a bulbous enlargement button 31, similar to those discussed above with respect to the criss-cross reinforcements. Since wire rope 23 is to be positioned vertically the upper end (FIG. 3) is retained by metal ceiling plate 40, which may be nailed or bolted as desired, to the top of ceiling plates 21. The bore 41 through wooden ceiling plates 21 is large enough to allow passage of buttons 31, at the lower end of wire rope 23, therethrough for ease in assembly of the reinforcements of this invention. The lower end of wire rope section 23 is packed into a restraining socket 51 drilled into concrete foundation 44. One enlarged button 31 is held in the bottom of the socket 51 which is then held in place by a metal e.g., iron, bronze, etc. sleeve 42 fitting around wire rope 23. Prior to positioning such sleeve 42, the remaining space adjacent button 31 is filled with epoxy adhesive and allowed to set into a solid filling 43. The entire strengthening structure depicted in FIG. 3 may be pre-fabricated, i.e., wire rope 23 passing through an opening of plate 40 before button 31 is swagged onto the upper end and sleeve 42 slipped onto wire rope 23 before button 31 is swagged onto the lower end. If desired, a keyhole opening may be provided in plate 40.

Figure 6:
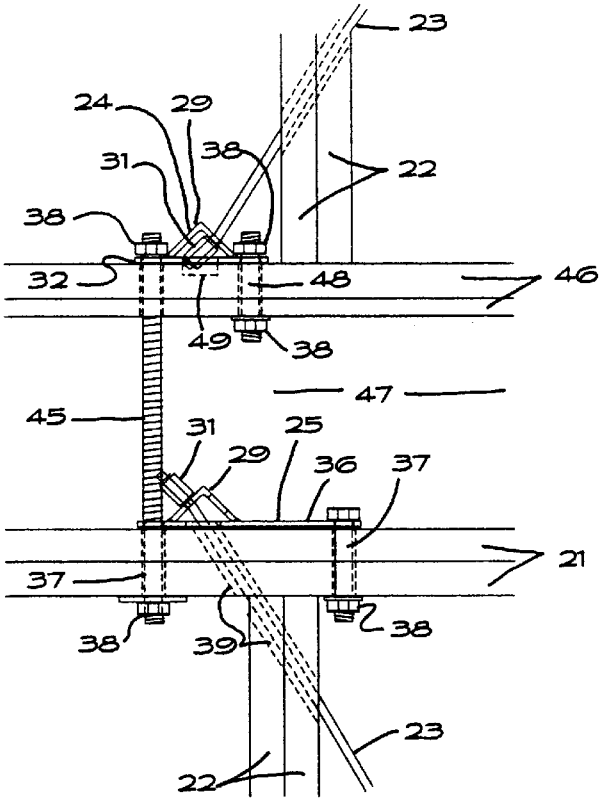
FIG. 6 an elevational view of a fixture and the attachment of two lengths of wire rope thereto for use in reinforcing a two-story structure in accordance with the present invention.

For a residential wooden house, a wire rope strand of approximately 0.25 inch diameter is adequate and the socket 51 of FIG. 3 might be 4 inches deep and 0.6 to 1.0 inch in diameter. For more complicated wooden structures, which might be 3–4 stories high slightly modified fittings might be advantageous, but the disclosed invention would remain applicable. The structure of FIG. 2 is a simple example where the combination of criss-cross bracing and linear bracing may be used. The fixtures on the ground floor of multi-storied wooden structures are identical to those described above for single-floor structures. Fixtures 24 and 27 are usable to anchor the lower ends of wire rope strands 23. The upper ends of those strands extending from the ground floor to the second floor are held by fixtures as shown in FIG. 6, as would be apparent to those skilled in this art. The fixture of FIG. 6 anchors two sections of wire rope 23 (i.e., that for each of the first and second floors of the dwelling). At the ceiling of the first floor the fixture is similar to that of FIG. 5 in which a bracket 29 anchors the button 31 on the first floor section of wire rope 23. Base plate 32 provides a firm seating for bolt 37 and nut 38. Wire rope 23 passes through bore 39 and through studs 22 as it stretches to the ground-floor anchor.

There is a space 47 between the first floor ceiling plates 21 and the second floor plates 46. It is preferred for added strength between floors to connect the two fixtures, 24 and 25 forming a combined fixture 26 with a long threaded rod or stud 45 having nuts 38 on each end thereof and allows a single size of stud to be adjusted in length to the exact size of space 47. Above the floor plates 46 for the second floor are the same reinforcing fixtures 25 described above with respect to FIG. 5. Bolt or stud 48 along with stud 45 holds base plate 32 in place and supports right angle bracket 29 which, in turn holds button terminal 31 on wire rope section 23. Cut-out section 49 allows room for end portions of button 31 and wire rope 23 to be free of plates 46.

Figure 7:
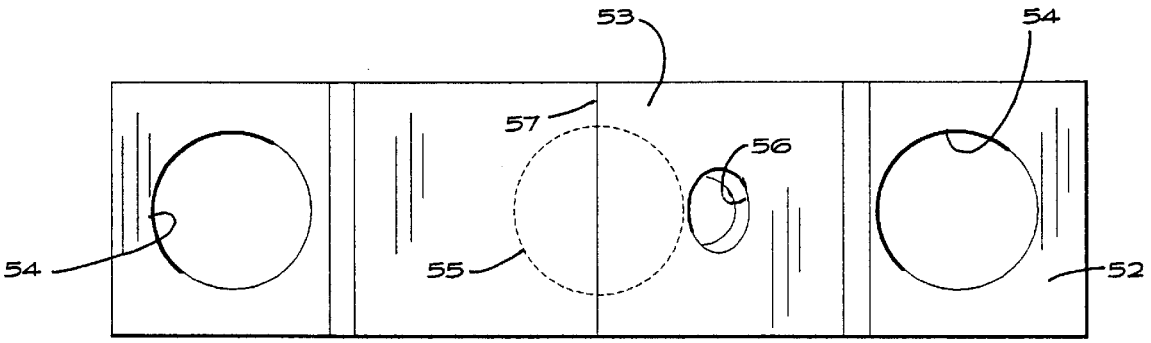
FIG. 7 is a top plan view of a fixture for use in attachment of a wire-rope reinforcement to a horizontal plate in accordance with this invention.
Figure 8:
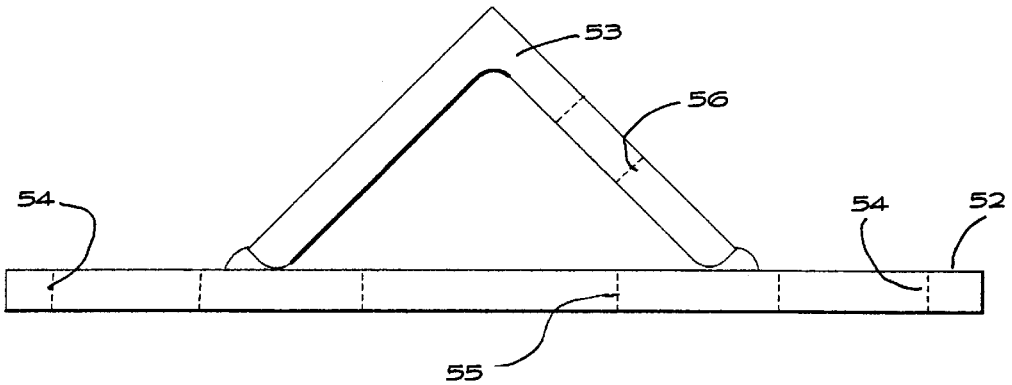
FIG. 8 is a front elevational view of the fixture of FIG. 7.

FIGS. 7 and 8 show the features of fixture 24 and base plate 32. This fixture 24 comprises a flat plate 52 and a right angle bracket portion 53 which are welded together as shown. Plate 52 contains two spaced bores 54 for bolts, as described with respect to FIGS. 4 and 6, and a central bore 55 to provide space for wire rope 23 to be present (see FIGS. 4, 5 and 6). One of the sloping sides of angle bracket 53 contains a small bore 56 which is large enough to allow wire rope strand 23 to pass through but small enough to prevent button terminal 31 from passing through. Since the fixture of FIGS. 7 and 8 is symmetrical about centerline 67 only one bore 56 is needed because the fixture can be turned to accommodate whichever direction wire rope strand 23 is employed.

Figure 9:
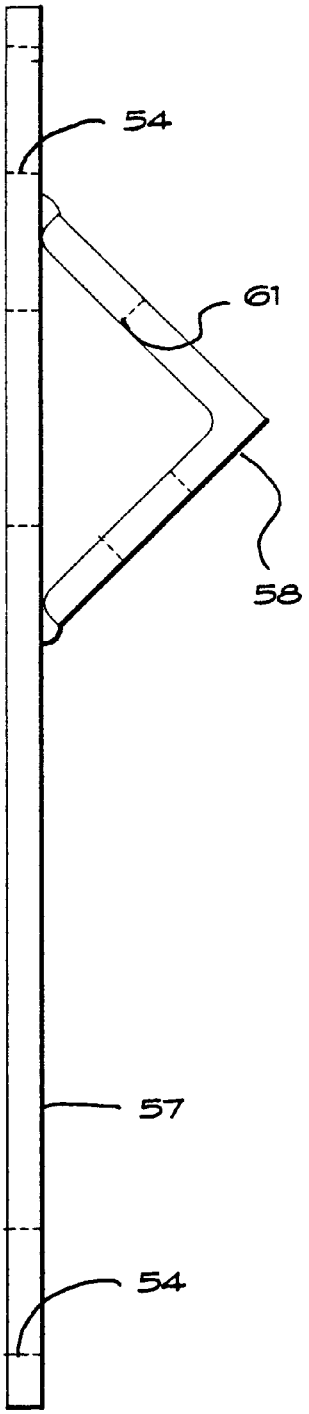
FIG. 9 is a top plan view of a fixture for use in attachment of a wire-rope reinforcement to a ceiling plate in a two-story structure in accordance with this invention.
Figure 10:
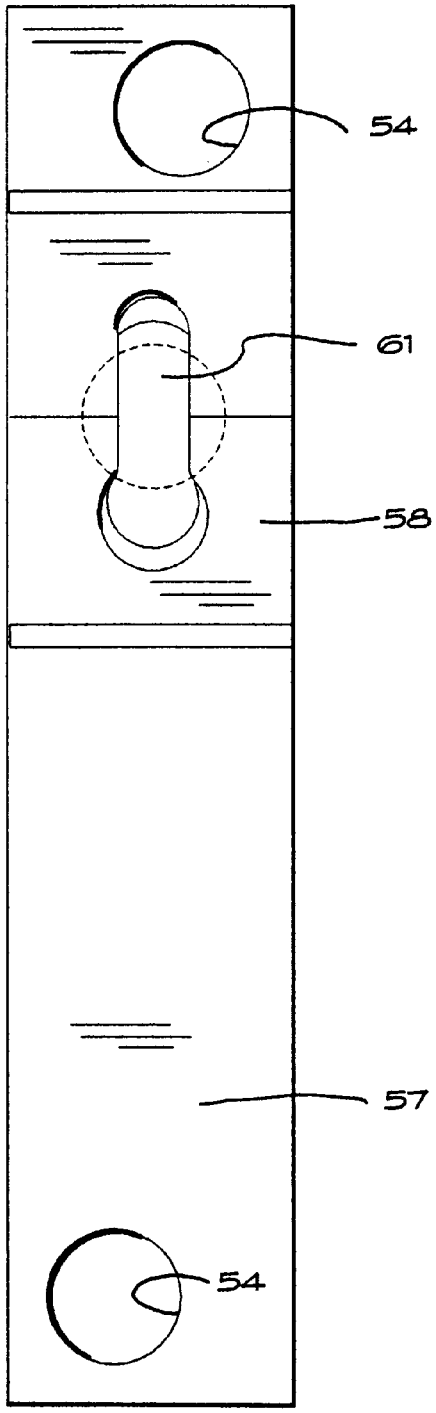
FIG. 10 is front elevational view of the fixture of FIG. 9.

The bracket or fixture 25 of FIGS. 9 and 10 is basically a larger version of that shown in FIGS. 7 and 8 and has a base plate 50. The fixture 25 includes a flat plate 57 welded to a corner section of a right angle bracket 58. Plate 57 contains two widely spaced bores 59 for bolts 37 or studs 45, and a bore 60 to provide a passageway for wire rope strand 23 which may lead to a lower button terminal 31 on the strand 23. A keyhole shaped bore 61 is included in right angle bracket 58 to permit right-hand or left-hand direction of wire rope strand 23 leading from this fixture to the next wire rope fixture above or below this one. This fixture (rather than that of FIGS. 7 and 8) is necessary because it is not symmetrical about bracket 58 and therefore there must be means to permit the builder to connect the wire rope reinforcement to the right or to the left. The shape and size of keyhole slot 61 provides a firm, secure grip onto wire rope strand 23 and terminal 31 used in this fixture.

An appropriate combination of the two types of reinforcements shown in this invention will generally protect any known wooden structure or dwelling. The vertical reinforcement of FIG. 3 may generally be employed in combination with the criss-cross reinforcement of FIGS. 4–6. About every 8 feet of horizontal distance there should be a vertical tie-down whether it is linear or criss-cross in design. Vertical shear and overturning stresses are easily resisted by the criss-cross design, and need not include large solid beams or solid sheeting, e.g., plywood, particle board, etc. It has been found to be more easily accomplished by using wire rope connections which can be threaded through passageways after the structure has been built. The terminals of the wire rope strand are prepared by swagging to form an enlarged button terminal which is easily held firm by catching the button terminal in a small opening. Criss-cross connections are especially useful for multi-story structures.

Figure 11:
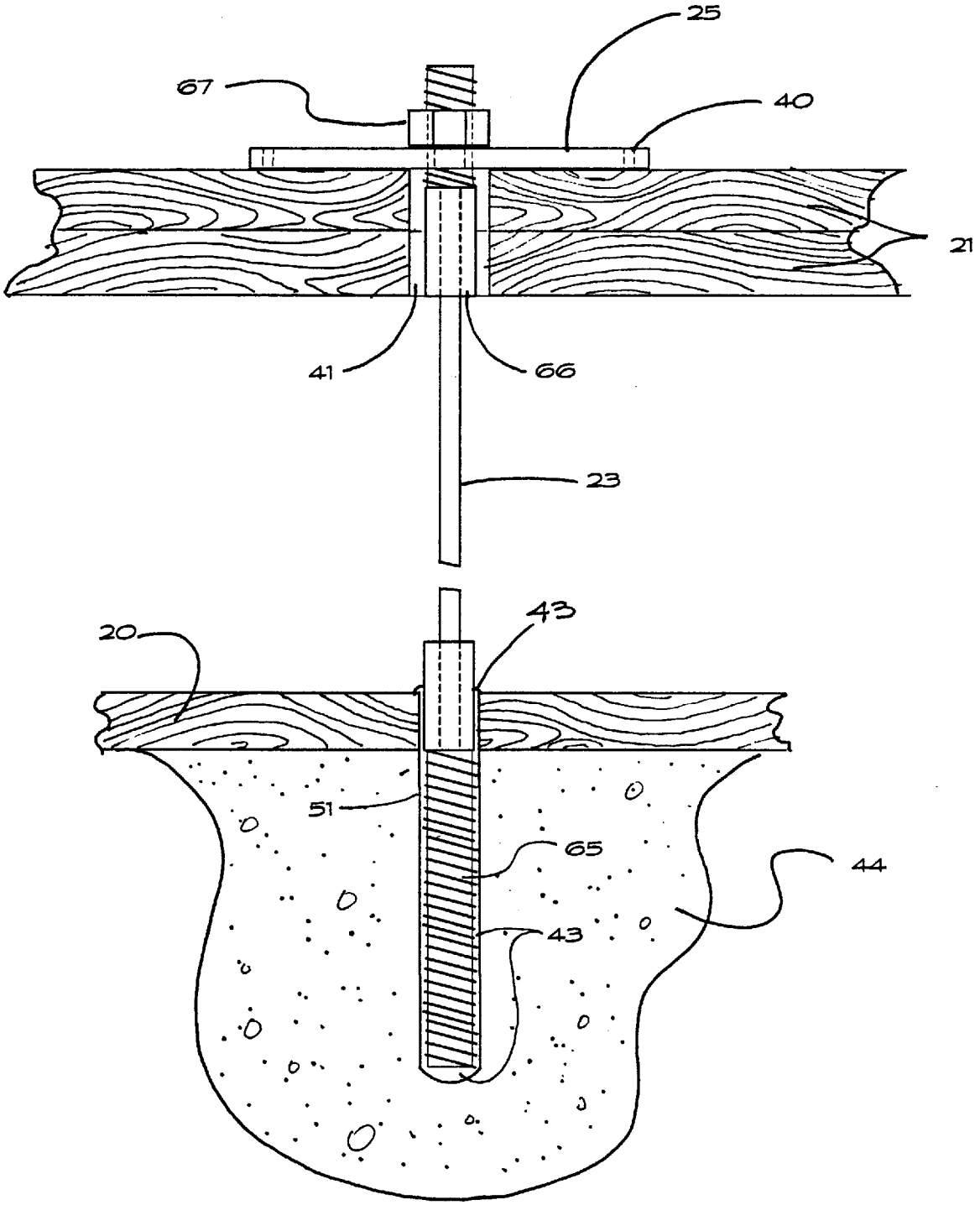
FIG. 11 is another embodiment of the attachment shown in FIG. 3.

FIG. 11 depicts another more expensive embodiment in which a threaded lower stud 65 is swagged onto wire rope 23 at the lower end thereof which in turn is embedded in the epoxy adhesive 43. This stud 65 has an upper end passing through the opening in the bottom wooden plate 20. Also, a threaded upper stud 66 is swagged onto wire rope 23 and passes through top opening in ceiling wooden plates 21 and metal plate 40 and a nut 67 is threadedly connected thereto above plate 40 and tightened to make wire rope 23 taut. This embodiment may be used in lieu of that described in connection with FIG. 3.

Figure 12:
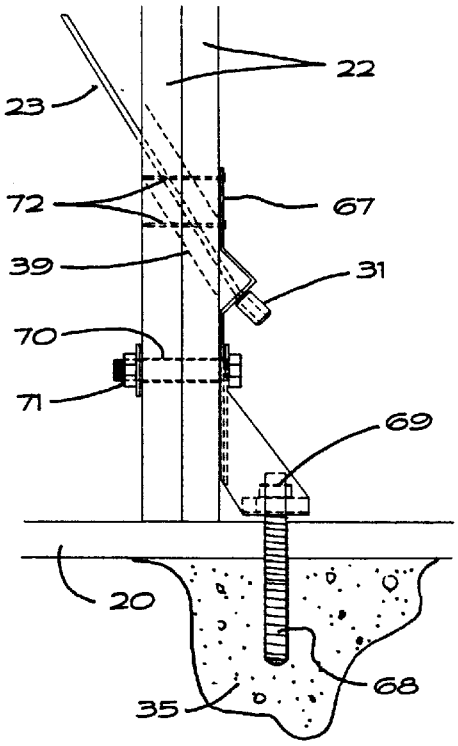
FIG. 12 is another embodiment of the attachment of FIG. 4.

FIG. 12 depicts an integral formed bracket 67 to which button 31 is attached with a threaded rod 68 embedded in the concrete. A nut 69 is threaded and tightened to make the wire rope 23 taut. Thereafter bolt 70 is passed through a drilled opening in studs 22 and a nut 71 is threaded thereon. Nails 72 connect the upper end of the bracket 67 to studs 22, and such attachments are more expensive and are in lieu of FIG. 4.

Figure 13:
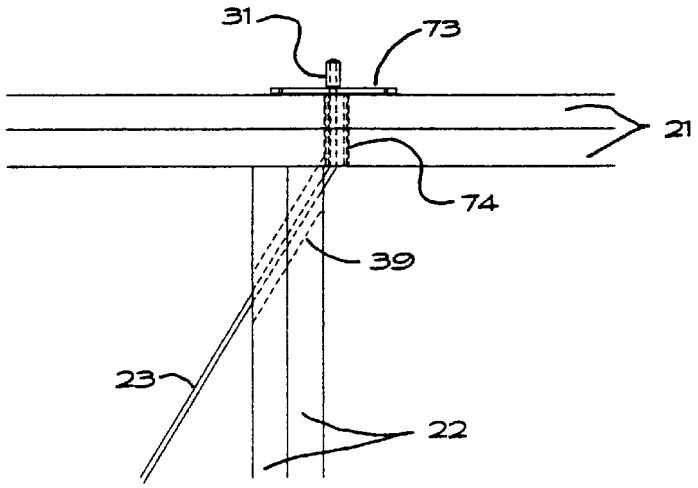
FIG. 13 is another embodiment of the attachment of FIG. 5.

FIG. 13 depicts another less expensive embodiment in which a flat ceiling plate 73, much like FIG. 3 plate 40, may be employed in lieu of top fixture 25 of FIG. 5. A metal sleeve 74 preferably is positioned in the vertical opening through wooden ceiling plates 21 which functions in much the same manner as metal sleeve 42 in FIG. 3. The bending of the wire rope 23 decreases the strength thereof and makes this embodiment less desirable than that depicted in FIG. 5.

Figure 14:
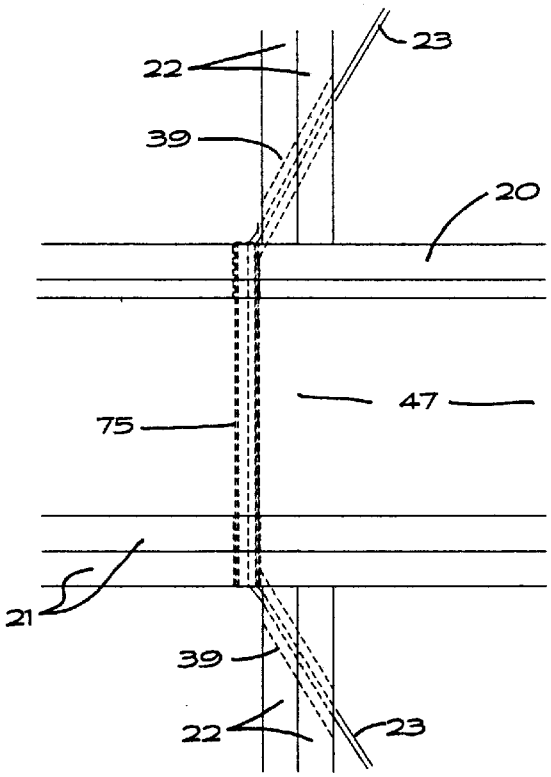
FIG. 14 is another embodiment of the attachment of of FIG. 6.

FIG. 14 depicts another embodiment when multilevel wooden buildings are to have the criss-cross arrangement in lieu of that depicted and described in connection with FIG. 6, which is preferred. In the space between and in the openings of the second floor wooden plate 20 (and floor if any) and the top plates 21 of the first floor is located a metal sleeve 75 with the wire rope 23 being continuous from the top plates of the second floor (not shown in FIG. 14) to the bottom plate of the first floor (not shown in FIG. 14), i.e., the upper end of cable 23 could be connected, as shown in either FIG. 5 or FIG. 13, and the bottom end of cable 23 could be connected, as shown in FIG. 4 or FIG. 12. The embodiment of FIG. 14 is much less expensive but does have some disadvantages, including less versatility, bending of the wire rope 23, etc.

In summary the present invention provides wood framed building structures, located in a high wind and/or seismic zone, an adequate resistance to uplift, shear and overturning forces. Also, the system can be installed after the structure has been framed, (or finished, with some repair of existing finishes when it is installed). In the case of uplift, every eight feet (8'-0" O.C. maximum), a continuous load path is developed from the top of the exterior load bearing wall to the foundation by using the wire rope. The wire rope 23 restrains the top plates 21 by passing through a steel plate 40, then through the wood top plates 21, floor system (if any), and wood bottom plate 20, floor system (if any), where it is placed into a hole drilled in the foundation 44 and embedded in epoxy adhesive 43 to bond the wire rope 23 to the concrete foundation 44. A four and one-half inch (4.5") steel sleeve 42 is placed where the wire rope 23 passes through the wood bottom plate 20 and into the foundation 44 to provide required resistance to horizontal shear loads. The ends of the wire rope 23 are secured by using button stops 31 which are swagged to it. One stop 31 is at the wood plate 21 end, and one button stops 31 is embedded in the epoxy adhesive 43. The roof is secured to the wood top plate by using "hurricane clips" well known in the art.

Vertical shear and overturning loads is resisted by using wire rope 23 forming an "X" connection between one (or more), wood studs spaced a minimum of 32" apart. The wire rope connection is made at the foundation by attaching it to a steel anchor 24, which is attached to the foundation 35 using anchor bolts 33. Holes are drilled through all studs 22 where it is attached to the top of the wood top plates 21 with a steel plate 36. Again, the wire rope 23 is secured by having one button stop 31 swagged to it at each end. In two (or more), story construction this same "X" connection is used directly above each segment on the first floor. The segments are preferably tied together from the first floor to the next through the floor system by use of a threaded rod 45 with nuts 38 at each end. Using this "X" connection develops adequate tension loads so that structural sheathing is not needed to create "Shear Wall Segments".

The present invention provides an enlarged, less complicated structural system wood frame construction, subjected to high wind and seismic destructive forces, simultaneously delivering a system that is less susceptible to improper installation and at lower cost. It is the only system that can be used to retrofit existing structures with minimal repair to system components while being installed.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. In a wood framed building including a foundation and walls constructed of a plurality of parallel vertical studs separating horizontal floor plates from horizontal ceiling plates, comprising a plurality of spaced lengths of wire rope strengthening wherein said walls against destructive wind and seismic forces, said of lengths of wire rope being stretched between said floor plates and said ceiling plates, said lengths of wire rope having bulbous terminals at respective ends of said lengths of wire rope stretched between said floor and ceiling plates, connector means attached to structural components of said building for securing said bulbous terminals.

2. The building of claim 1 wherein at least some of said connector means are attached to said foundation and to a floor plate.

3. The building of claim 2 wherein at least some other of said connector means are attached to said ceiling plates.

4. The building of claim 3 wherein each of at least some other of said connector means includes a metal plate located above said ceiling plates, said metal plate having an opening therethrough for the passage of said wire rope and stopping the passage of said bulbous terminal above said metal plate.

5. The building of claim 4 wherein each of at least some of said other of said connector means includes a metal sleeve surrounding said wire rope above its lower said bulbous terminal, said metal sleeve and lower bulbous terminal being firmly secured in an opening of said foundation.

6. The building of claim 1 wherein at least some of said connector means each includes a threaded stud forming said bulbous terminal with its threaded portion being embedded in said foundation.

7. The building of claim 6 wherein each of at least some other of said connector means includes another threaded stud and a metal plate located above said ceiling plates, said metal plate having an opening through which the threaded portion of said another stud extends, and a nut threaded on said threaded portion above said plate and forming said bulbous terminal.

8. The building of claim 1 wherein said building has two stories, some of said lengths of wire rope are substantially vertical and connect said floor plate of a first said story to a top plate of a next vertically adjacent room of a second said story.

9. The building of claim 8 wherein some of said lengths of wire rope are positioned in pairs to form cross braces each in the shape of a letter "X" and with said wire ropes forming a pair being located in substantially the same vertical plane.

10. The building of claim 9 further comprising connector means for attaching said wire ropes forming a pair to said foundation and to said ceiling plates on said first story and connector means for attaching said wire ropes forming another said pair to a floor plate of said next room of said second story and to said top plate of said next room of said second story.

11. The building of claim 9 wherein one said cross brace is located in a wall of a room of a first said story and another said cross brace is located in said next room of said second story, said one and another cross braces being formed of two of said wire ropes.

12. The building of claim 11 further comprising a pair of spaced metal sleeves between said top plates of said first story and said floor plate of said second story with a respective said wire rope of said cross braces passing through respective said metal sleeves.

13. The building of claim 9 wherein said wire ropes of each said cross brace is maintained taut and is substantially straight throughout its respective lengths.

14. The building of claim 1 wherein some of said lengths of wire rope are positioned angularly with respect to each other so as to form cross braces for each pair of said wire rope in the shape of a letter "X" and located in substantially the same vertical plane.

15. The building of claim 14 wherein each major wall of said building includes at least one said cross brace.

16. The building of claim 1 wherein said bulbous terminals are swagged onto said ends of said lengths of wire ropes.

17. The building of claim 1 further comprising a metal plate above said ceiling plate.

18. In a wood framed building including a foundation and walls constructed of a plurality of parallel vertical studs separating horizontal floor plates from horizontal ceiling plates comprising a plurality of spaced lengths of wire rope having bulbous terminals swagged onto respective ends thereof, said lengths of wire rope being stretched between said floor plates and said ceiling plates, spaced connector means for attachment with said bulbous terminals of said lengths of wire rope, said connector means including metal plates above said ceiling plates, said bulbous terminals engaging respective said metal plates, each said metal plate having an opening therethrough for passage of respective said lengths of wire rope while said plate inhibits passage of said bulbous terminal engaged therewith, said connector means adjacent said floor plates including means below said floor plates for anchoring said bulbous terminals adjacent lower ends of said wire ropes to sub-floor structural components of said building.

19. The building of claim 18 wherein said means below said floor plates include spaced bores in said foundation for receiving said bulbous terminals adjacent said floor plates and adhesive filling said bores to secure said bulbous terminals therein.

20. The building of claim 18 wherein said means below said floor plates further include metal sleeves located in respective said bores surrounding respective said lengths of wire rope and extending between respective said bulbous terminals and upwardly through said floor plates.

21. The building of claim 18 wherein some of said lengths of wire rope are positioned angularly with respect to each other so as to form cross braces for each pair of said lengths of wire rope in the shape of a letter "X" and located in substantially the same vertical plane, each major wall of said building including at least one said cross brace.

22. In a wood framed building including a foundation structure and walls constructed of a plurality of parallel vertical studs separating horizontal floor plates from horizontal ceiling plates, a plurality of spaced lengths of wire rope having bulbous terminals swagged onto respective ends, said lengths of wire ropes being stretched between said floor plates and said ceiling plates, some of said lengths of wire rope being positioned angularly with respect to each other so as to form cross braces for each pair of said lengths of wire rope in the shape of a letter "X" and located in substantially the same vertical plane in each major wall of said building, some other of said lengths of wire rope being spaced around said building and extending substantially vertically within outer walls of said building, each said other of said lengths of wire rope having their bulbous terminals adjacent said ceiling plates located above said ceiling plate and inhibiting movement of said ceiling plates upwardly, each said other of said lengths of wire rope having their bulbous terminals adjacent said floor plates connected to said foundation structure.

23. In a wood framed building including a foundation and walls constructed of a plurality of parallel vertical studs separating horizontal floor plates from horizontal ceiling plates, comprising a plurality of spaced lengths of wire rope strengthening wherein said walls against destructive wind and seismic forces, said of lengths of wire rope being stretched between said floor plates and said ceiling plates, connector means, said lengths of wire rope having bulbous terminals stretched between said floor and ceiling plates with said terminals securely fastened by said connector means to structural components of said building, at least some of said connector means being attached to said foundation and to a floor plate, at least some other of said connector means being attached to said ceiling plates, each of at least some other of said connector means including a metal plate located above said ceiling plates, said metal plate having an opening therethrough for the passage of said wire rope and stopping the passage of said bulbous terminal above said metal plate, each of at least some of said other of said connector means includes a metal sleeve surrounding said wire rope above its lower said bulbous terminal, said metal sleeve and lower bulbous terminal being firmly secured in an opening of said foundation.

24. In a wood framed building including a foundation and walls constructed of a plurality of parallel vertical studs separating horizontal floor plates from horizontal ceiling plates, comprising a plurality of spaced lengths of wire rope strengthening wherein said walls against destructive wind and seismic forces, said of lengths of wire rope being stretched between said floor plates and said ceiling plates, connector means, said lengths of wire rope having bulbous terminals stretched between said floor and ceiling plates with said terminals securely fastened by said connector means to structural components of said building.

25. The building of claim 24 wherein each of at least some other of said connector means includes another threaded stud and a metal plate located above said ceiling plates, said metal plate having an opening through which the threaded portion of said another stud extends, and a nut threaded on said threaded portion above said plate and forming said bulbous terminal.

26. The building of claim 24 wherein each of said bulbous terminals is located at each end of each of said lengths of wire ropes.

27. The bulding of claim 24 wherein each of said bulbous terminals is swagged onto opposite end portions of each of said lengths of wire ropes.

28. In a wood framed building including a foundation and walls constructed of a plurality of parallel vertical studs separating horizontal floor plates from horizontal ceiling plates, comprising a plurality of spaced lengths of wire rope strengthening wherein said walls against destructive wind and seismic forces, said of lengths of wire rope being stretched between said floor plates and said ceiling plates, connector means, said lengths of wire rope having bulbous terminals stretched between said floor and ceiling plates with said terminals securely fastened by said connector means to structural components of said building, said building having two stories, some of said lengths of wire rope are substantially vertical and connect said floor plate of a first said story to a top plate of a next vertically adjacent room of a second said story, some of said lengths of wire rope being positioned in pairs to form cross braces each in the shape of a letter "X" and with said wire ropes forming a pair being located in substantially the same vertical plane, one said cross brace being located in a wall of a room of a first said story and another said cross brace is located in said next room of said second story, said one and another cross braces being formed of two of said wire ropes, and a pair of spaced metal sleeves between said top plates of said first story and said floor plate of said second story with a respective said wire rope of said cross braces passing through respective said metal sleeves.

* * * * *